US008998433B2

(12) United States Patent
Li et al.

(10) Patent No.: US 8,998,433 B2
(45) Date of Patent: Apr. 7, 2015

(54) LIGHT EMITTING DEVICE UTILIZING REMOTE WAVELENGTH CONVERSION WITH IMPROVED COLOR CHARACTERISTICS

(75) Inventors: Yi-Qun Li, Danville, CA (US); Yi Dong, Tracy, CA (US); James Caruso, Albuquerque, NM (US); Charles Edwards, Pleasanton, CA (US)

(73) Assignee: Intematix Corporation, Fremont, CA (US)

( * ) Notice: Subject to any disclaimer, the term of this patent is extended or adjusted under 35 U.S.C. 154(b) by 207 days.

(21) Appl. No.: 13/273,208

(22) Filed: Oct. 13, 2011

(65) Prior Publication Data

US 2012/0140435 A1 Jun. 7, 2012

Related U.S. Application Data

(63) Continuation-in-part of application No. 13/087,549, filed on Apr. 15, 2011, which is a continuation of application No. 11/714,711, filed on Mar. 6, 2007, now Pat. No. 7,937,865.

(60) Provisional application No. 60/780,902, filed on Mar. 8, 2006.

(51) Int. Cl.
*F21V 9/16* (2006.01)
*G09F 13/22* (2006.01)
(Continued)

(52) U.S. Cl.
CPC ..... *G09F 13/22* (2013.01); *G09F 13/20* (2013.01); *F21K 9/135* (2013.01); *F21K 9/56* (2013.01); *F21S 4/008* (2013.01); *F21S 8/02* (2013.01); *F21V 9/00* (2013.01); *F21V 9/16* (2013.01); *F21Y 2101/02* (2013.01)

(58) Field of Classification Search
USPC ..... 362/84, 293, 311.02
See application file for complete search history.

(56) References Cited

U.S. PATENT DOCUMENTS 2,509,707 A 5/1950 Taylor
3,504,214 A 3/1970 Cox et al.
(Continued)

FOREIGN PATENT DOCUMENTS

CN 2620344 Y 6/2004
CN 1655657 A 8/2005
(Continued)

OTHER PUBLICATIONS

Office Action dated Mar. 16, 2011 for Chinese Appln. No. 200780012858.8.
Office Action dated Mar. 8, 2010 for Chinese Appln. No. 200780012858.8.
(Continued)

*Primary Examiner* — Robert May
(74) *Attorney, Agent, or Firm* — Vista IP Law Group, LLP

(57) ABSTRACT

A light emitting device includes a radiation source operable to generate and radiate excitation energy, the source being configured to irradiate a wavelength conversion component with excitation energy and the wavelength conversion component comprising a layer of photo-luminescent material configured to emit radiation of a selected color when irradiated by the radiation source and a color enhancement filter layer configured to filter undesirable wavelengths of an emission product of the layer of photo-luminescent material to establish a final emission product for the light emitting device.

17 Claims, 14 Drawing Sheets

(51) Int. Cl.

| | |
|---|---|
| ***G09F 13/20*** | (2006.01) |
| ***F21K 99/00*** | (2010.01) |
| ***F21S 4/00*** | (2006.01) |
| ***F21S 8/02*** | (2006.01) |
| ***F21V 9/00*** | (2006.01) |
| *F21Y 101/02* | (2006.01) |

(56) References Cited

U.S. PATENT DOCUMENTS

| | | | | |
|---|---|---|---|---|
| 3,510,976 | A | 5/1970 | Parry et al. | |
| 3,780,462 | A | 12/1973 | Pregel et al. | |
| 4,971,417 | A * | 11/1990 | Krinsky et al. | 359/333 |
| 5,856,031 | A | 1/1999 | Burrows | |
| 6,068,383 | A * | 5/2000 | Robertson et al. | 362/84 |
| 6,250,767 | B1 | 6/2001 | Kusafuka et al. | |
| 6,299,338 | B1 | 10/2001 | Levinson et al. | |
| 6,604,841 | B2 | 8/2003 | Liu | |
| 6,883,926 | B2 | 4/2005 | Wojnarowski | |
| 7,052,152 | B2 * | 5/2006 | Harbers et al. | 362/30 |
| 7,091,661 | B2 * | 8/2006 | Ouderkirk et al. | 313/512 |
| 7,168,834 | B2 | 1/2007 | Takeda et al. | |
| 7,246,919 | B2 * | 7/2007 | Porchia et al. | 362/276 |
| 2002/0186556 | A1 | 12/2002 | Wojnarowski | |
| 2003/0182833 | A1 | 10/2003 | Lewis | |
| 2003/0218180 | A1 | 11/2003 | Fujiwara | |
| 2003/0227007 | A1 | 12/2003 | Ezuhara et al. | |
| 2004/0173807 | A1 | 9/2004 | Tian et al. | |
| 2006/0001037 | A1 | 1/2006 | Schardt et al. | |

FOREIGN PATENT DOCUMENTS

| | | | |
|---|---|---|---|
| CN | 1664440 | A | 9/2005 |
| GB | 2404775 | A | 2/2005 |
| JP | H09179512 | A | 7/1997 |
| JP | 9-258678 | | 10/1997 |
| JP | H11259026 | A | 9/1999 |
| JP | 2001228812 | A | 8/2001 |
| JP | 3690852 | B | 8/2005 |
| JP | 2009265634 | A | 11/2009 |
| TW | M278984 | | 10/2005 |
| WO | WO 00/01986 | A1 | 1/2000 |
| WO | WO 2006017595 | A2 | 2/2006 |

OTHER PUBLICATIONS

European Extended Search Report dated Jul. 29, 2013 for EP Appln. No. 07752430.4.

Office Action dated Oct. 2, 2012 for Japanese Appln. No. 2008-558362.

Examination Report dated May 23, 2013 for KR Appln. No. 10-2008-7024653.

Office Action dated Feb. 6, 2010 for Taiwanese Appln. No. 096107849.

Office Action dated Oct. 6, 2010 for Taiwanese Appln. No. 096107849.

Foreign Office Action dated Sep. 16, 2013 for Taiwanese Appln. No. 099127800.

Final Office Action dated Aug. 7, 2012 for U.S. Appl. No. 13/087,549.

Non-Final Office Action dated May 10, 2013 for U.S. Appl. No. 13/102,898.

Search Report & Written Opinion dated Oct. 19, 2007 for PCT Appln. No. PCT/US07/05729.

Final Office Action dated Aug. 21, 2012 for U.S. Appl. No. 13/102,898.

Non-Final Office Action dated May 1, 2012 for U.S. Appl. No. 13/087,549.

Non-Final Office Action dated May 1, 2012 for U.S. Appl. No. 13/102,898.

Non-Final Office Action dated May 4, 2010 for U.S. Appl. No. 11/714,711.

Non-Final Office Action dated Oct. 11, 2011 for U.S. Appl. No. 13/102,833.

Notice of Allowance dated Jan. 28, 2011 for U.S. Appl. No. 11/714,711.

Notice of Allowance dated May 8, 2012 for U.S. Appl. No. 13/102,833.

Office Action dated Jan. 14, 2014 for Japanese Appln. No. 2008-558362.

Examination Report dated Dec. 27, 2013 for KR Appln. No. 10-2008-7024653.

Office Action dated Dec. 10, 2013 for Chinese Appl. No. 201110455158.4.

Office Action dated Jul. 21, 2014 for Chinese Appln. No. 201110455158.4.

* cited by examiner

LIGHT EMITTING DEVICE UTILIZING REMOTE WAVELENGTH CONVERSION WITH IMPROVED COLOR CHARACTERISTICS

CROSS-REFERENCE TO RELATED APPLICATIONS

The present application is a continuation-in-part of U.S. application Ser. No. 13/087,549, filed on Apr. 15, 2011, which is a continuation of U.S. application Ser. No. 11/714,711, filed on Mar. 6, 2007, now issued as U.S. Pat. No. 7,937,865, which claims the benefit of U.S. Provisional Application Ser. No. 60/780,902, filed on Mar. 8, 2006, which are all hereby incorporated by reference in their entirety.

FIELD

The disclosure relates to light emitting devices which utilize remote wavelength conversion, and particularly to implementing a wavelength conversion component with improved color characteristics for a light emitting device.

BACKGROUND

Commercial and entertainment lighting applications such as lighting for advertisements, disco lighting, theater lighting, stage lighting, traffic lighting, etc. often times require light to be emitted with high color saturation for optimal presentation. Typically, high color saturation is generated by applying a narrow selective filter to an incandescent light source. The light source generates white light, which comprises a combination of light with different wavelengths in the visible spectrum. The filter selectively filters the white light to provide the desired color light emission. The color pigments, dyes, or colorants, used in these filters are typically transparent color filters which absorb the unwanted color light. While this system generates highly saturated color light, it also wastes a significant portion of the light generated by the light source, as a significant portion is absorbed by the selective filter rather than being transmitted.

White light emitting diodes (LEDs) are known in the art and are a relatively recent innovation. It was not until LEDs emitting the blue/ultraviolet of the electromagnetic spectrum were developed that it became practical to develop white light sources based on LEDs. As is known white light generating LEDs ("white LEDs") include photo-luminescent materials (e.g., one or more phosphor materials), which absorbs a portion of the radiation emitted by the LED and re-emits radiation of a different color (e.g., range of wavelengths). For example, the LED emits blue light in the visible part of the spectrum and the phosphor re-emits yellow or a combination of green and red light, green and yellow, or yellow and red light. The portion of the visible blue light emitted by the LED which is not absorbed by the phosphor mixes with the yellow light emitted to provide light which appears to the eye as being white. In addition to generating white light, the combination of an LED and photo-luminescent material may be configured to generate any number of colors in the visible spectrum.

This provides much more efficient use of the LED light source, as a significant amount of light generated by the LED light source is transmitted or absorbed and re-emitted by the photo-luminescent material.

However, a problem that arises is that although a photo-luminescent material may create sufficient light in the target color wavelength, this is typically a much broader emission curve than desired for high color saturation. This may be particularly problematic for certain type of lighting that require high color saturation, such as lighting for advertisements, disco lighting, theater lighting, stage lighting, traffic lighting.

Therefore, there is a need for an improved approach to improve the color characteristics for LED lighting devices.

SUMMARY OF THE INVENTION

Embodiments of the invention concern a light emitting device that utilizes remote wavelength conversion with improved color characteristics. In some embodiments, the light emitting device includes a radiation source operable to generate and radiate excitation energy, the source being configured to irradiate a wavelength conversion component with excitation energy and the wavelength conversion component comprising a layer of photo-luminescent material configured to emit radiation of a selected color when irradiated by the radiation source and a color enhancement filter layer configured to filter undesirable wavelengths of an emission product of the layer of photo-luminescent material to establish a final emission product for the light emitting device.

BRIEF DESCRIPTION OF THE DRAWINGS

In order that the present invention is better understood light emitting devices and wavelength conversion components in accordance with the invention will now be described, by way of example only, with reference to the accompanying drawings in which like reference numerals are used to denote like parts, and in which.

DETAILED DESCRIPTION OF THE INVENTION

Figure 1:
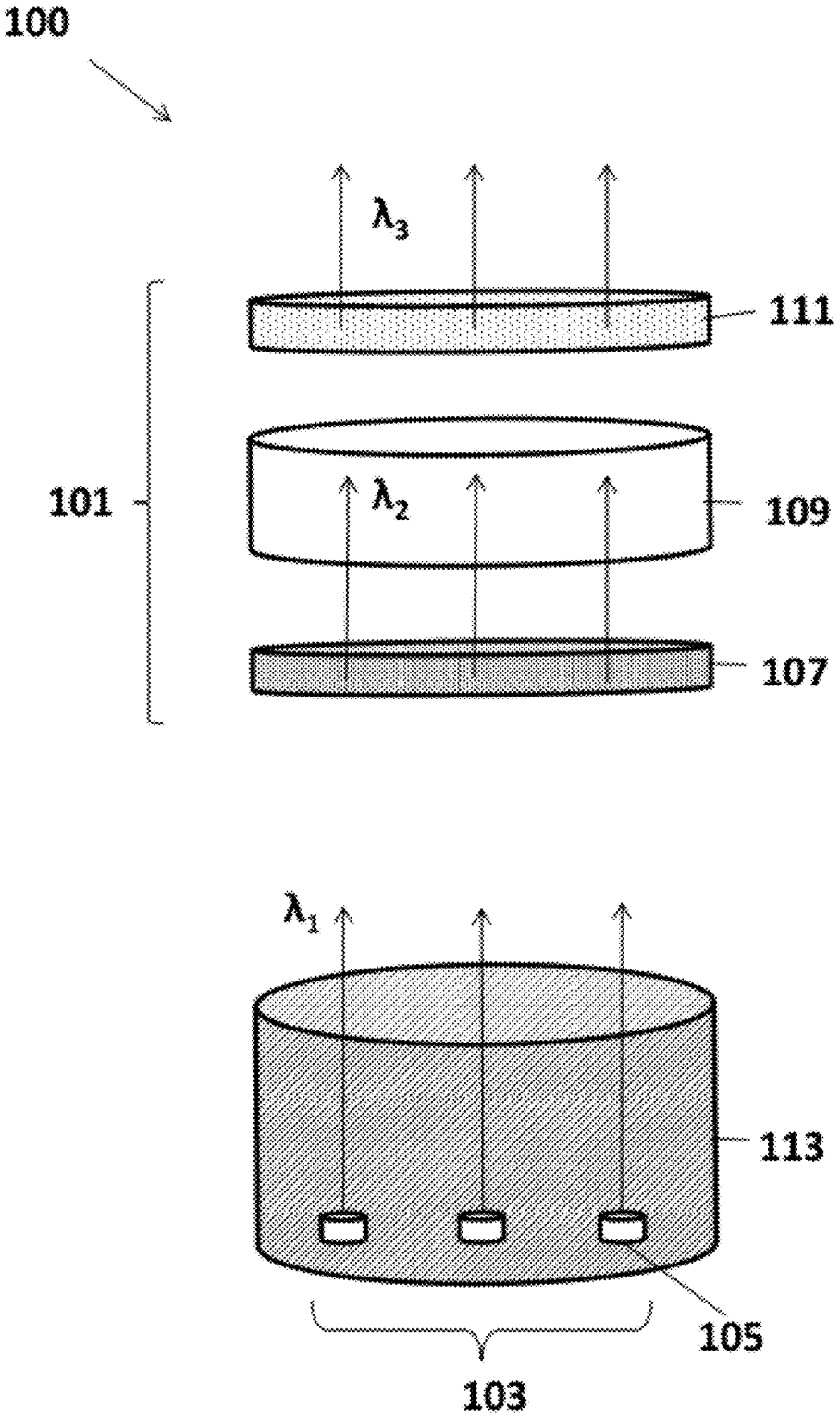
FIG. 1 illustrates an exploded perspective diagram of a light emitting device according to some embodiments.

Various embodiments are described hereinafter with reference to the figures. It should be noted that the figures are not necessarily drawn to scale. It should also be noted that the figures are only intended to facilitate the description of the embodiments, and are not intended as an exhaustive description of the invention or as a limitation on the scope of the invention. In addition, an illustrated embodiment need not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

For the purposes of illustration only, the following description is made with reference to photo-luminescent material embodied specifically as phosphor materials. However, the invention is applicable to any type of photo-luminescent material, such as either phosphor materials or quantum dots. A quantum dot is a portion of matter (e.g. semiconductor) whose excitons are confined in all three spatial dimensions that may be excited by radiation energy to emit light of a particular wavelength or range of wavelengths. As such, the invention is not limited to phosphor based wavelength conversion components unless claimed as such.

The use of a light emitting device with photo-luminescent materials in combination with a light source to absorb light of a first range of wavelengths and convert that light into light of a second range of wavelengths is known. The emission product of the light emitting device is a combination of the light generated by the photo-luminescent material and the light generated by the light source which is not absorbed by the photo-luminescent material. When the light source takes on the form of blue LEDs, the photo-luminescent material may be composed of color emissive phosphors, in particular Blue Activated Emissive Colorants (BAEC).

It has been assumed so far that the blend of BAEC phosphors can be used to create a desired color saturation for the full color space. However, many phosphors have broader light emission spectrums than desired for highly saturated color. Also using the phosphors to completely eliminate all blue light leakage from the LEDs may require a very thick layer of phosphor which may be inefficient or undesirable.

According to some embodiments of the invention, a color enhancement layer (also referred to herein as a "color filter layer" or "color enhancement filter layer") can be used to achieve improved color saturation. The color enhancement layer is placed in the path between the phosphor layer and the emission path of the final emission product. The color enhancement layer functions as a filter that narrows the light emission spectrum of the final emission product from the lighting apparatus. In this way, the color enhancement/filter layer serves to greatly improve the color saturation quality of the final emission product.

While the problem has been described with respect to the use of blue LEDs and photo-luminescent material comprising BAEC, it is important to note that the invention may be applicable to a number of different radiation sources in combination with a number of different photo-luminescent materials.

FIG. 1 illustrates an exploded perspective diagram of a light emitting device 100 according to some embodiments. The light emitting device 100 includes a wavelength conversion component 101 located remotely from a radiation source 103. The term "remotely" and "remote" refer to a spaced or separated relationship. For example, the wavelength conversion component may be separated from the radiation source by at least 1 cm. The radiation source 103 comprises a number of light emitting diodes (LEDs) 105. In some embodiments, the LEDs 105 are blue LEDs which emit blue light in a wavelength range of 410 to 470 nm. In some other embodiments, the radiation source may be a U.V. emitting LED.

The radiation source 103 is housed in a light emitting device housing 113, which may be configured in various shapes depending on the application. The light emitting device housing 113 may be fabricated from sheet metal, molded from a plastics material or constructed from any other suitable material.

The wavelength conversion component 101 includes a layer of photo-luminescent material 107. Any appropriate photo-luminescent material may be used provided that the photo-luminescent material is excitable by radiation emitted by the radiation source 103 (e.g., LEDs). In some embodiments, the layer of photo-luminescent material 107 may comprise a phosphor material mixed with a carrier material. In other embodiments, the layer of photo-luminescent material 107 may also include other photo-luminescent material such as quantum dots.

When the layer of photo-luminescent material 107 comprises a phosphor material mixed with a carrier material, the carrier material must be substantially transmissive to light in the visible spectrum (e.g., 380-740 nm). At such wavelengths, the carrier material should be able to transmit at least 90% of visible light. Such carrier materials may include a polymer resin, a monomer resin, an acrylic, an epoxy, a silicone or a fluorinated polymer. Furthermore, the carrier material should have an index of refraction that is substantially similar to the indices of refraction of the light transmissive hermetic substrates in order to ensure proper transmission of light through the wavelength conversion component 101. For a layer of photo-luminescent material 107 comprising phosphor material mixed with a carrier material, the phosphor material can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in U.S. Pat. No. 7,575,697 B2 "Silicate-based green phosphors", U.S. Pat. No. 7,601,276 B2 "Two phase silicate-based yellow phosphors", U.S. Pat. No. 7,655,156 B2 "Silicate-based orange phosphors" and U.S. Pat. No. 7,311,858 B2 "Silicate-based yellow-green phosphors". The phosphor can also comprise an aluminate-based material such as is taught in co-pending patent application US2006/0158090 A1 "Novel aluminate-based green phosphors" and patent U.S. Pat. No. 7,390,437 B2 "Aluminate-based blue phosphors", an aluminum-silicate phosphor as taught in co-pending application US2008/0111472 A1 "Aluminum-silicate orange-red phosphor" or a nitride-based red phosphor material such as is taught in co-pending United States patent application US2009/0283721 A1 "Nitride-based red phosphors" and International patent application WO2010/074963 A1 "Nitride-based red-emitting in RGB (red-green-blue) lighting systems". It will be appreciated that the phosphor material is not limited to the examples described and can comprise any phosphor material including nitride and/or sulfate phosphor materials, oxy-nitrides and oxy-sulfate phosphors or garnet materials (YAG).

The wavelength conversion component 101 may further include a light transmissive substrate 109 such as for example a polycarbonate, polythene, acrylic or glass sheet. The light transmissive substrate 109 must be substantially transmissive to light in the visible spectrum (e.g., 380-740 nm). At such wavelengths, the light transmissive substrate 109 should ideally be able to transmit at least 90% of visible light.

The wavelength conversion component 101 also comprises a color enhancement filter layer 111. The color enhancement filter layer 111 comprises a color pigment and/or colored dye which is incorporated into, for example, a vinyl film or mixed with a binder material and provided as a layer on the substrate. As is known, color pigments are insoluble and can be organic such as for example Ciba's RED 254, a DIKETO-PYRROLO-PYRROLE compound or inorganic such as for example iron oxide, while color dyes are soluble.

In operation, the radiation source 103 (e.g., LEDs) generates and radiates excitation energy (e.g., light) of a selected wavelength range $\lambda_1$ towards the wavelength conversion component. The excitation energy causes the layer of photo-luminescent material 107 of the wavelength conversion component 101 to emit radiation (e.g., light) of a selected color (e.g., range of wavelengths $\lambda_2$). When generating light of a selected color with a high color saturation, the layer of photo-luminescent material 107 is configured to absorb substantially all of the light generated by the radiation source 103. However a small portion of the light generated by the radiation source $\lambda_1$ may not be absorbed by the layer of photo-luminescent material 107 of the wavelength conversion component 101 and may instead be transmitted through the layer of photo-luminescent material 107. The emission product of the layer of photo-luminescent material 107 of the wavelength conversion component 101 can thus a combination of the light emitted by the photo-luminescent material $\lambda_2$ and the small portion of light generated by the radiation source $\lambda_1$ that is not absorbed by the layer of photo-luminescent material 107.

The use of blue light as a radiation source in conjunction with a combination of red and green light emissive phosphors enables a virtually continuous palette of light colors/hues to be generated by the display surface from a single color excitation source, preferably an inexpensive blue LED. For example, blue light can be generated by an LED alone without the need for a phosphor. Red light can be generated by use of a thick layer of red phosphor and green light by a thick layer of green phosphor. A thick layer refers to a sufficient quantity/concentration of phosphor to absorb all of the incident excitation radiation.

Yellow light can be produced by a green phosphor whose quantity is insufficient to absorb all of the blue light impinging on it such that the emitted light is a combination of blue and green light which appears yellow in color to the eye. In a like manner, mauve/purple light can be produced using a red phosphor whose quantity is insufficient to absorb all of the blue light such that the blue light combined with the yellow light emitted give an emitted light which appears mauve in color to the eye. It will be appreciated that a virtually continuous palette of colors and hues can be generated by an appropriate selection of phosphor material combination and/or quantity.

As discussed above, the emission product of the layer of photo-luminescent material 107 of the wavelength conversion component 101 will have a broader emission curve than desired for high color saturation. This is due to the inherent nature of photo-luminescent materials such as phosphors, which have broader light emission spectrums than desired for highly saturated color or due to the light generated by the radiation source that is not absorbed by the layer of photo-luminescent material. As such the color enhancement filter layer 111 is configured to filter the undesirable wavelengths of the emission product of the layer of photo-luminescent material 107 such that a final emission product ($\lambda_3$) established by the wavelength conversion component 101 is highly saturated (e.g., smaller range of wavelengths). For example, when the emission product of the layer of photo-luminescent material comprises a particular range of wavelengths, the color enhancement filter layer may be configured to filter out a portion of those wavelengths such that the final emission product of the light emitting device may comprise a full width half maximum (FWHM) of the range of wavelengths corresponding to the emission product of the layer of photo-luminescent material.

Figure 2:
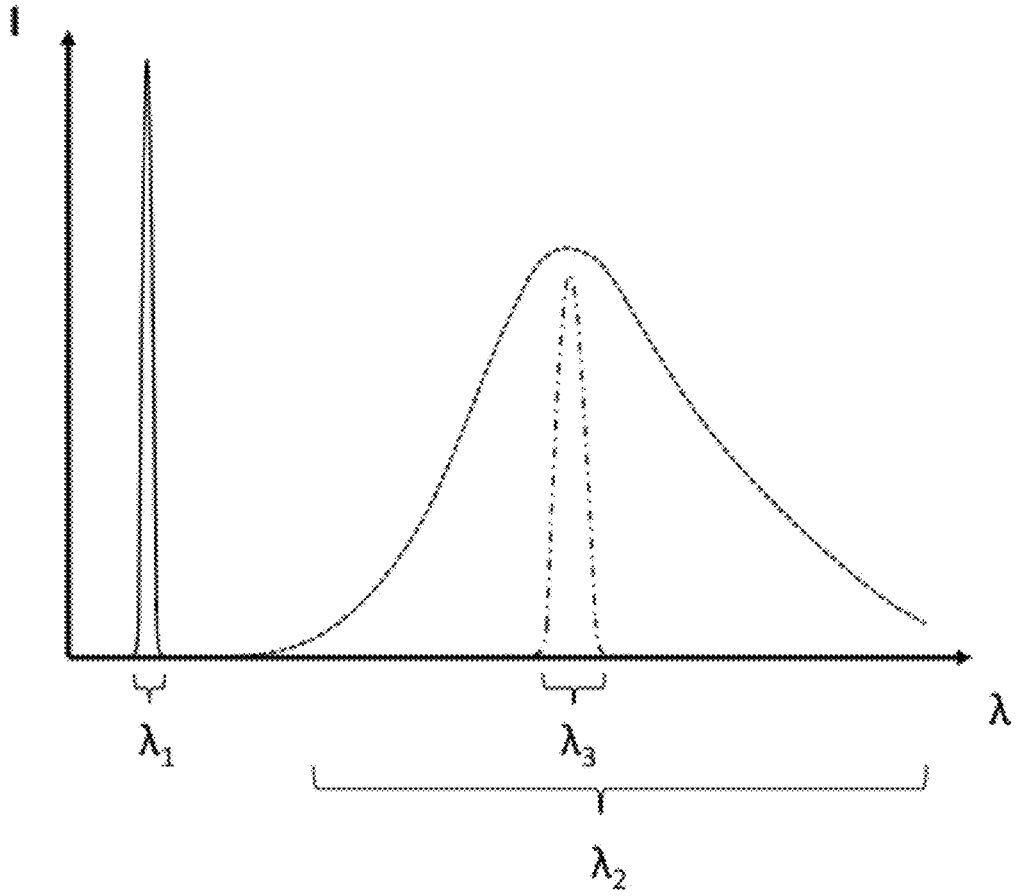
FIG. 2 is a graph illustrating an example range of intensity versus wavelength values for light generated by the light source, light generated by the wavelength conversion component, and light emitted by the color enhancement filter layer.

FIG. 2 is a graph illustrating an example range of intensity versus wavelength values for light generated by the light source, light generated by the wavelength conversion component, and light emitted by the color enhancement filter layer. The light generated by the light source may fall within a wavelength range indicated by $\lambda_1$. The light generated by the wavelength conversion component may then fall within a wavelength range indicated by $\lambda_2$. Finally, the light that passes through the color enhancement filter layer may fall within a wavelength range indicated by $\lambda_3$. The light generated by the phosphor materials within the wavelength conversion component has a wavelength range that may be independent of the light generated by the light source because the light generated by the light source of wavelength $\lambda_1$ is converted into light of another wavelength $\lambda_2$ by a process of photoluminescence. The light that is emitted from the color enhancement filter layer having wavelength $\lambda_3$ has a wavelength range that is overlaps the wavelength range of light generated by the phosphors within the wavelength conversion component $\lambda_2$. However, the light emitted from the color enhancement filter layer $\lambda_3$ has a more narrow wavelength range than the light generated by the phosphors within the wavelength conversion component $\lambda_2$ because undesirable wavelengths generated by the layer of photo-luminescent material are filtered by the color enhancement filter layer.

Figure 3:
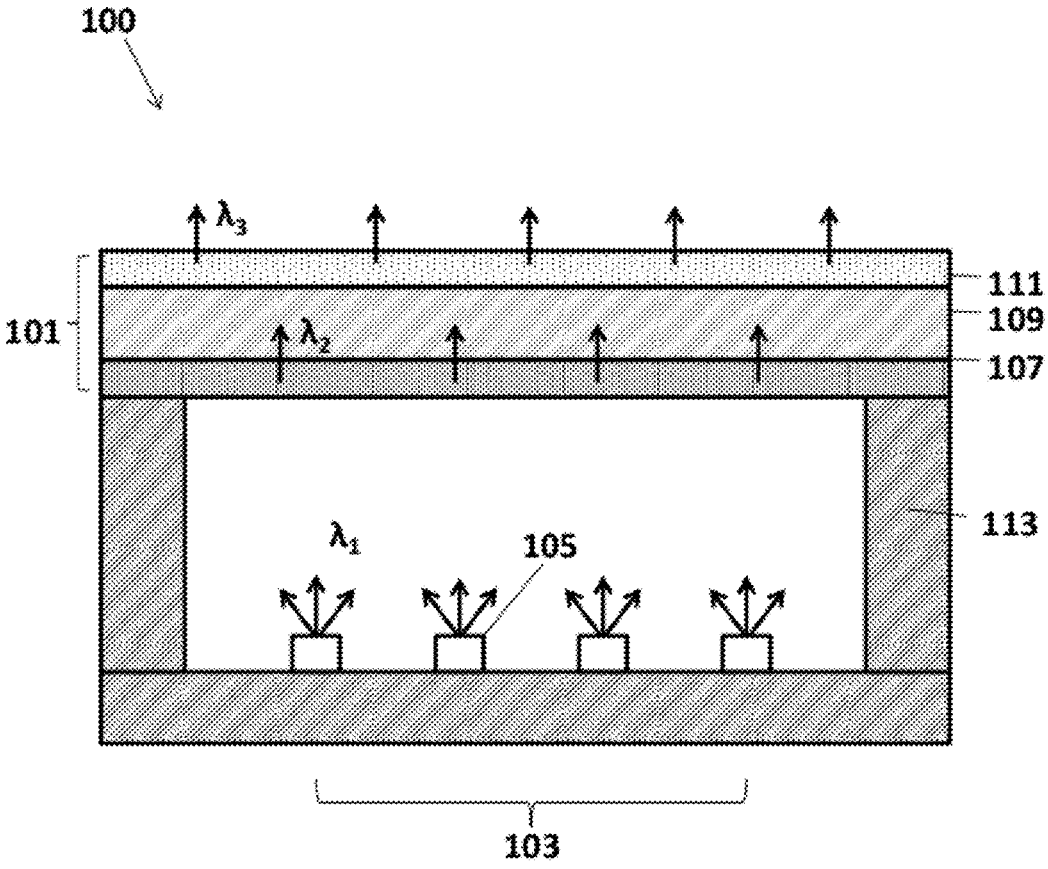
FIG. 3 illustrates a cross-sectional view of the light emitting device of FIG. 1.
Figure 4:
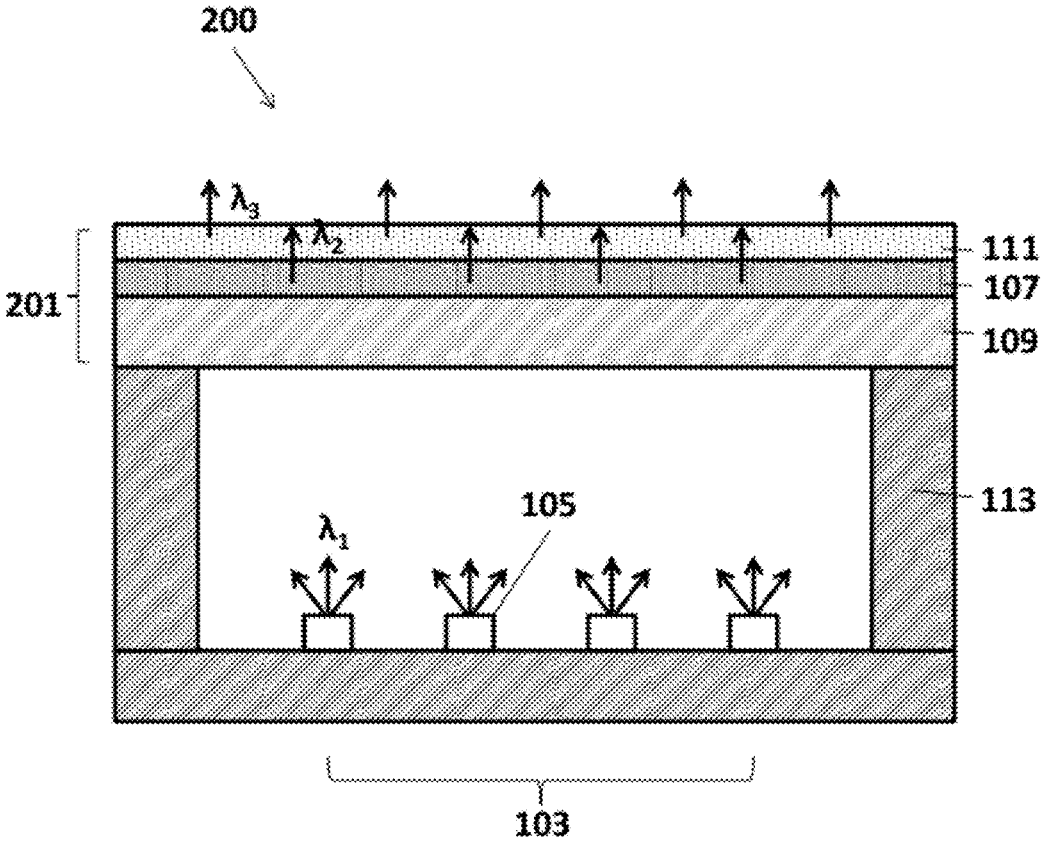
FIG. 4 illustrates a cross-sectional view of a light emitting device according to some other embodiments.
Figure 5:
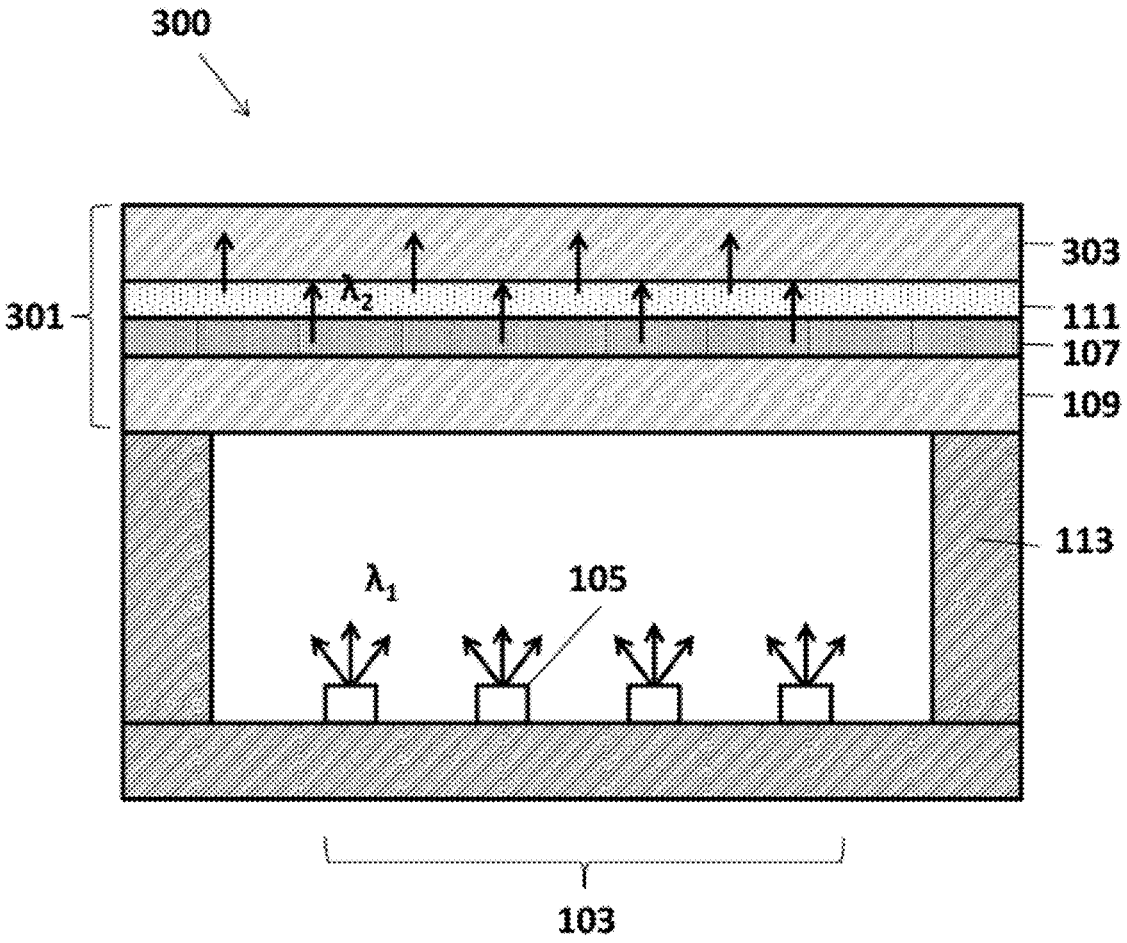
FIG. 5 illustrates a cross-sectional view of a light emitting device according to some other embodiments.

The wavelength conversion component of the light emitting device may be implemented in any number of different configurations. FIGS. 3-5 illustrate cross-sectional views of light emitting devices according to some embodiments.

FIG. 3 illustrates a cross-sectional view of the light emitting device 100 of FIG. 1. The light emitting device 100 includes a wavelength conversion component 101 located remotely from a radiation source 103. The radiation source 103 is housed within a light emitting device housing 113 and may comprise a number of light emitting diodes (LEDs) 105.

The wavelength conversion component 101 includes a layer of photo-luminescent material 107, a light transmissive substrate 109, and a color enhancement filter layer 111. The layer of photo-luminescent material 107 may be provided on an under surface, that is the surface facing the radiation source 103, of the light transmissive substrate 109. The color enhancement filter layer 111 may be provided on a top surface, that is the surface facing away from the radiation source 103, of the light transmissive substrate 109.

The light emitting device 100 of FIG. 3 operates in accordance with the description provided with respect to FIG. 1. The radiation source 103 (e.g., LEDs 105) generates and radiates excitation energy (e.g., light) of a selected wavelength range $\lambda_1$ towards the wavelength conversion component 101. The excitation energy causes the layer of photo-luminescent material 107 of the wavelength conversion component 101 to emit radiation (e.g., light) of a selected color (e.g., range of wavelengths $\lambda_2$). In some embodiments, the layer of photo-luminescent material 107 may be configured to absorb substantially all of the light generated by the radiation source 103. However a small portion of the light generated by the radiation source $\lambda_1$ may not be absorbed by the layer of photo-luminescent material 107 of the wavelength conversion component 101 and may instead be transmitted through the layer of photo-luminescent material 107. The emission product of the layer of photo-luminescent material 107 is thus a combination of the light emitted by the layer of photo-luminescent material $\lambda_2$ and the small portion of light generated by the radiation source $\lambda_1$ that is not absorbed by the layer of photo-luminescent material 107. The color enhancement filter layer 111 filters the undesirable wavelengths of the emission product of the photo-luminescent material ($\lambda_1$, $\lambda_2$) such that the final emission product of the light emitting device 100 is highly saturated (e.g., smaller range of wavelengths $\lambda_3$).

FIG. 4 illustrates a cross-sectional view of a light emitting device 200 according to some other embodiments. The light emitting device 200 may include a wavelength conversion component 201 located remotely from a radiation source 103. The radiation source 103 may be housed within a light emitting device housing 113 and may comprise a number of light emitting diodes (LEDs) 105. The wavelength conversion component 201 may include a layer of photo-luminescent material 107, a light transmissive substrate 109, and a color enhancement filter layer 111.

Unlike the approach of FIG. 3, the layer of photo-luminescent material 107 in FIG. 4 is provided on a top surface, that is the surface facing away from the radiation source 103, of the light transmissive substrate 109. The color enhancement filter layer 111 may be provided on a top surface, that is the surface facing away from the radiation source 103, of the layer of photo-luminescent material 107.

The light emitting device 200 of FIG. 4 also operates in accordance with the description provided with respect to FIG. 1. The radiation source 103 (e.g., LEDs 105) generates and radiates excitation energy (e.g., light) of a selected wavelength range $\lambda_1$ towards the wavelength conversion component 201. The excitation energy passes through the light transmissive substrate 109 and causes the layer of photo-luminescent material 107 of the wavelength conversion component 201 to emit radiation (e.g., light) of a selected color (e.g., range of wavelengths $\lambda_2$). In some embodiments, the layer of photo-luminescent material 107 may be configured to absorb substantially all of the light generated by the radiation source 103. However a small portion of the light generated by the radiation source $\lambda_1$ may not be absorbed by the layer of photo-luminescent material 107 and may instead be transmitted through the layer of photo-luminescent material 107. The emission product of the layer of photo-luminescent material 107 is thus a combination of the light emitted by the layer of photo-luminescent material $\lambda_2$ and the small portion of light generated by the radiation source $\lambda_1$ that is not absorbed by the layer of photo-luminescent material 107. The color enhancement filter layer 111 filters the undesirable wavelengths of the emission product of the photo-luminescent material ($\lambda_1$, $\lambda_2$) such that the final emission product of the light emitting device 200 is highly saturated (e.g., smaller range of wavelengths $\lambda_3$).

FIG. 5 illustrates a cross-sectional view of a light emitting device 300 according to other embodiments. The light emitting device 300 includes a wavelength conversion component 301 located remotely from a radiation source 103. The radiation source 103 is housed within a light emitting device housing 113 and may comprise a number of light emitting diodes (LEDs) 105.

The wavelength conversion component 301 includes a layer of photo-luminescent material 107, a light transmissive substrate 109, a color enhancement filter layer 111, and an additional light tranmissive substrate 303. The layer of photo-luminescent material 107 may be provided on a top surface, that is the surface facing away from the radiation source 103, of the light transmissive substrate 109. The color enhancement filter layer 111 may be provided on a top surface, that is the surface facing away from the radiation source 103, of the layer of photo-luminescent material 107. The additional light transmissive substrate 303 may be provided on a top surface, that is the surface facing away from the radiation source 103, of the color enhancement filter layer 111. The light transmissive substrate 109 and the additional light transmissive substrate 303 are configured to protect the layer of photo-luminescent material 107 and the color enhancement filter layer 111 from external environmental contaminants (e.g., water).

The light emitting device 300 of FIG. 5 also operates in accordance with the description provided with respect to FIG. 1. The radiation source 103 (e.g., LEDs 105) generates and radiates excitation energy (e.g., light) of a selected wavelength range $\lambda_1$ towards the wavelength conversion component 301. The excitation energy passes through the light transmissive substrate 109 and causes the layer of photo-luminescent material 107 of the wavelength conversion component 301 to emit radiation (e.g., light) of a selected color (e.g., range of wavelengths $\lambda_2$). In some embodiments, the layer of photo-luminescent material 107 may be configured to absorb substantially all of the light generated by the radiation source 103. However a small portion of the light generated by the radiation source $\lambda_1$ may not be absorbed by the layer of photo-luminescent material 107 and may instead be transmitted through the layer of photo-luminescent material 107. The emission product of the layer of photo-luminescent material 107 is thus a combination of the light emitted by the layer of photo-luminescent material $\lambda_2$ and the small portion of light generated by the radiation source $\lambda_1$ that is not absorbed by the layer of photo-luminescent material 107. The color enhancement filter layer 111 filters the undesirable wavelengths of the emission product of the photo-luminescent material ($\lambda_1$, $\lambda_2$) such that the final emission product of the light emitting device 300 is highly saturated (e.g., smaller range of wavelengths $\lambda_3$).

Figure 6:
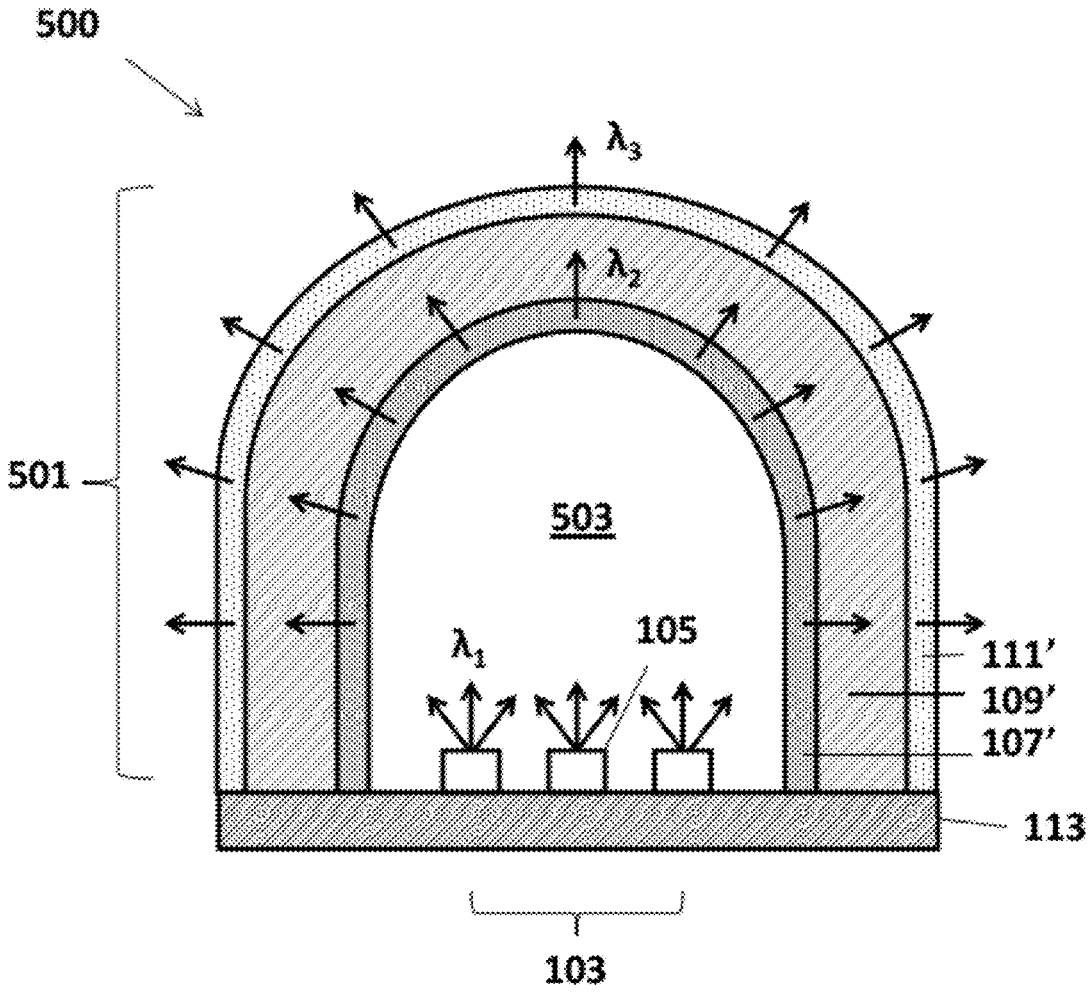
FIG. 6 illustrates a cross-sectional view of a light emitting device according to some other embodiments.

While FIGS. 3-5 illustrate the wavelength conversion components in a two-dimensional configuration (e.g., is generally planar or flat), alternate wavelength conversion components may also be implemented as three-dimensional configurations, non-flat shapes. FIG. 6 illustrates a cross-sectional view of a light emitting device 500 with a wavelength conversion component 501 having a three-dimensional configuration (e.g., elongated dome shaped and/or ellipsoidal shell) according to some other embodiments. In this embodiment, the wavelength conversion component 501 is in the shape of an elongated dome shaped shell whose inner surface defines an interior volume 503. This is in contrast to the two-dimensional shape (e.g., generally planar) shape of the wavelength conversion components described above. Such three-dimensional components may be useful for applications where it is necessary or desired for light emitted from the light emitting device 500 to be spread over a larger solid angle.

The wavelength conversion component 501 is located remotely from a radiation source 103. The radiation source 103 may be housed within a light emitting device housing 113 and may comprise a number of light emitting diodes (LEDs) 105. The LEDs 105 are generally located within the interior volume 503 defined by the inner surface of the three-dimensional shape of the wavelength conversion component 501.

The three-dimensional wavelength conversion component 501 includes a layer of photo-luminescent material 107', a light transmissive substrate 109', and a color enhancement filter layer 111'. The layer of photo-luminescent material 107' may be embodied as a three-dimensional configuration and be provided on an under surface, that is the surface facing the radiation source 103, of the light transmissive substrate 109' (which may also take on a three-dimensional configuration). The color enhancement filter layer 111' may also take on a three-dimensional shape and be provided on a top surface, that is the surface facing away from the radiation source 103, of the light transmissive substrate 109'.

The light emitting device 500 of FIG. 6 operates in accordance with the description provided above. The radiation source 103 (e.g., LEDs 105) generates and radiates excitation energy (e.g., light) of a selected wavelength range $\lambda_1$ towards the wavelength conversion component 501. The excitation energy causes the layer of photo-luminescent material 107' of the wavelength conversion component 501 to emit radiation (e.g., light) of a selected color (e.g., range of wavelengths $\lambda_2$). When generating light of a selected color with a high color saturation, the layer of photo-luminescent material 107' is configured to absorb substantially all of the light generated by the radiation source 103. However a small portion of the light generated by the radiation source $\lambda_1$ may not be absorbed by the layer of photo-luminescent material 107' of the wavelength conversion component 501 and may instead be transmitted through the layer of photo-luminescent material 107'. The emission product of the layer of photo-luminescent material 107' can thus be a combination of the light emitted by the layer of photo-luminescent material $\lambda_2$ and the small portion of light generated by the radiation source $\lambda_1$ that is not absorbed by the layer of photo-luminescent material. The emission product of the layer of photo-luminescent material 107' passes through the light transmissive substrate 109' and the color enhancement filter layer 111' filters the undesirable wavelengths of the emission product of the photo-luminescent material ($\lambda_1$, $\lambda_2$) such that the final emission product ($\lambda_3$) of the light emitting device 500 is highly saturated (e.g., smaller range of wavelengths).

Figure 7A:
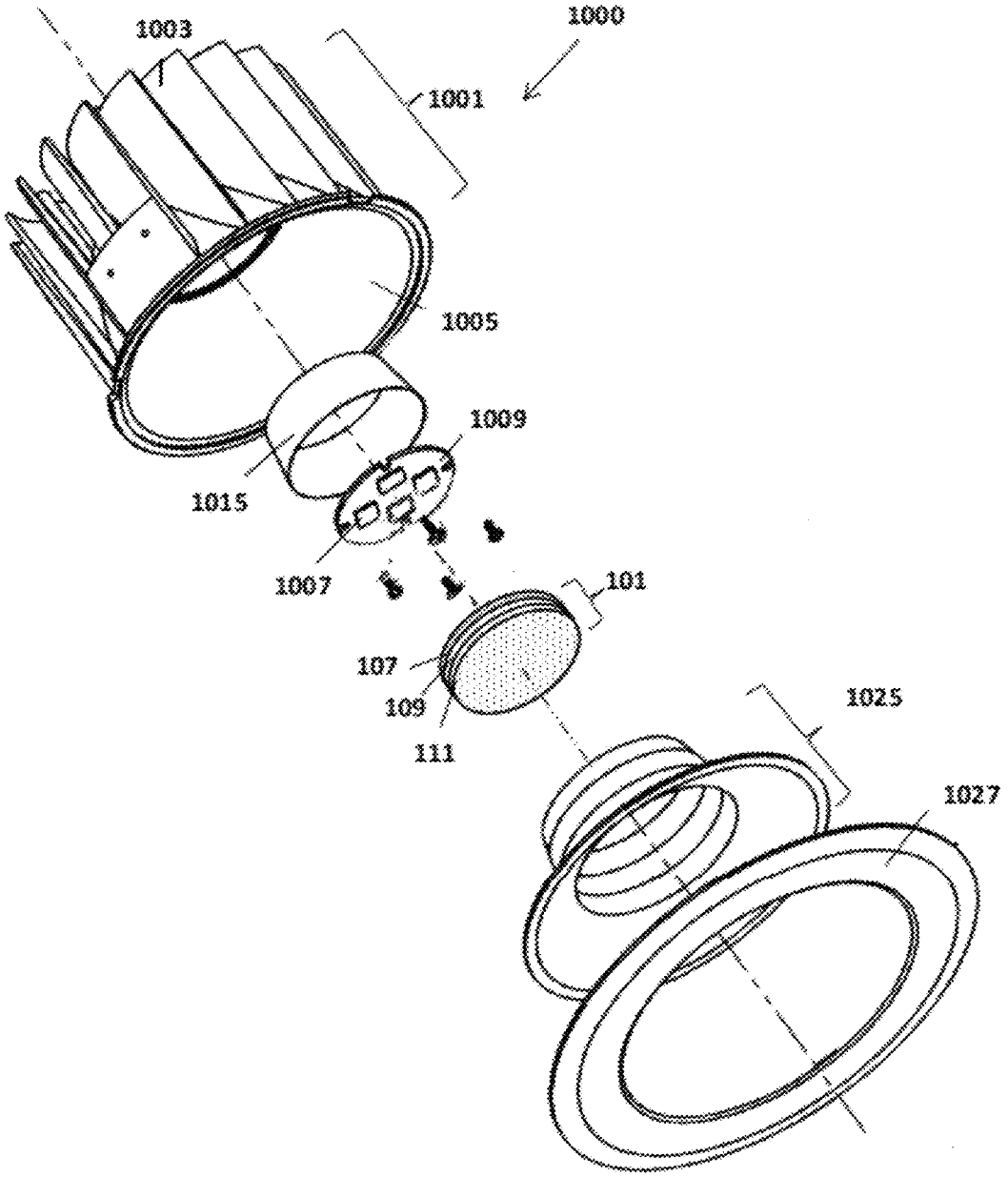
FIGS. 7A, 7B, and 7C illustrate an example of an application of a wavelength conversion component in accordance with some embodiments.
Figure 7B:
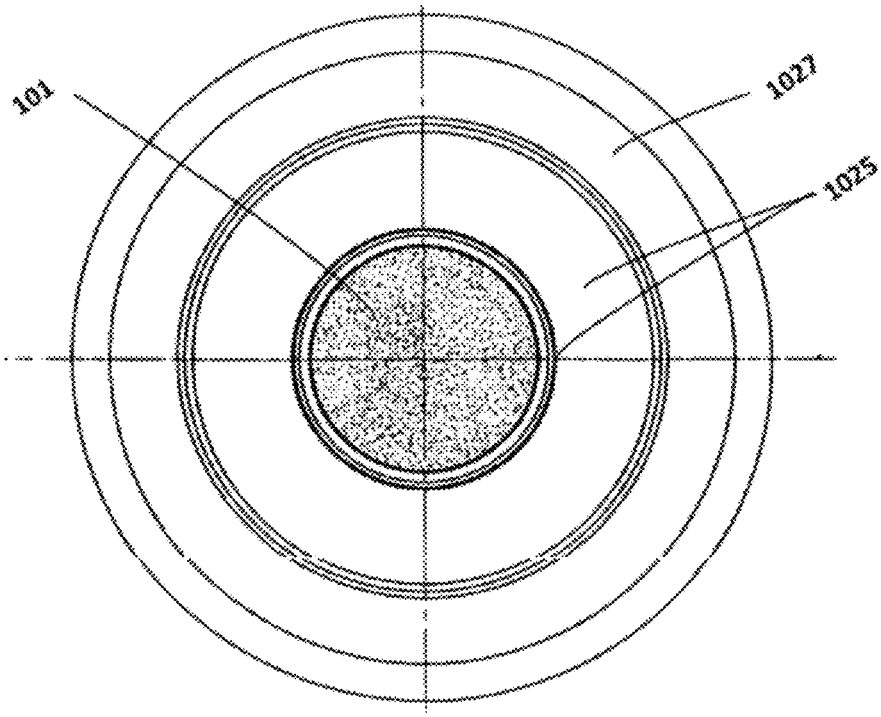
Figure 7C:
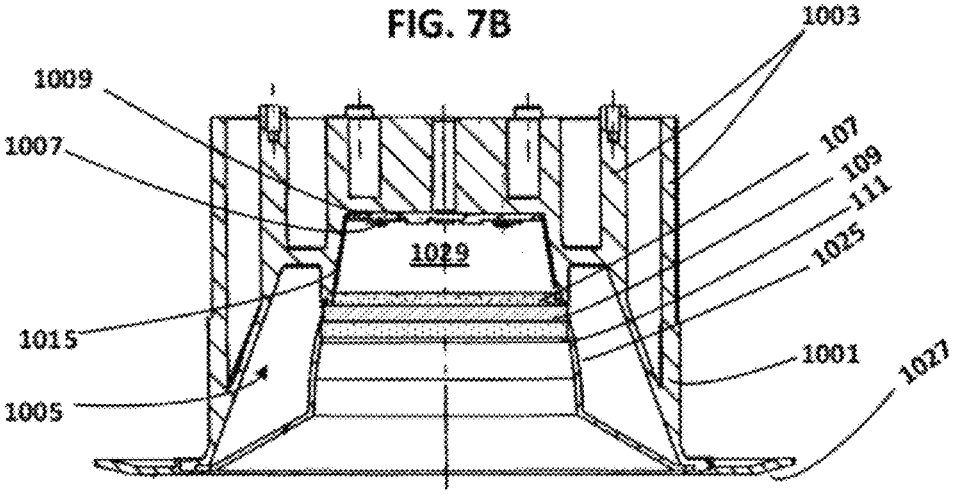

FIGS. 7A, 7B, and 7C illustrate an example of an application of a wavelength conversion component in accordance with some embodiments. FIG. 7A, 7B, and 7C illustrates an LED downlight 1000 that utilizes remote wavelength conversion in accordance with some embodiments. FIG. 7A is an exploded perspective view of the LED downlight 1000, FIG. 7B is an end view of the downlight 1000, and FIG. 7C is a sectional view of the downlight 1000. The downlight 1000 is configured to generate light with an emission intensity of 650-700 lumens and a nominal beam spread of 60° (wide flood). It is intended to be used as an energy efficient replacement for a conventional incandescent six inch downlight.

The downlight 1000 comprises a hollow generally cylindrical thermally conductive body 1001 fabricated from, for example, die cast aluminum. The body 1001 functions as a heat sink and dissipates heat generated by the light emitters 1007. To increase heat radiation from the downlight 1000 and thereby increase cooling of the downlight 1000, the body 1001 can include a series of latitudinal spirally extending heat radiating fins 1003 located towards the base of the body 1001. To further increase the radiation of heat, the outer surface of the body can be treated to increase its emissivity such as for example painted black or anodized. The body 1001 further comprises a generally frustoconical (i.e. a cone whose apex is truncated by a plane that is parallel to the base) axial chamber 1005 that extends from the front of the body a depth of approximately two thirds of the length of the body. The form factor of the body 1001 is configured to enable the downlight to be retrofitted directly in a standard six inch downlighting fixture (can) as are commonly used in the United States.

Four solid state light emitters 1007 are mounted as a square array on a circular shaped MCPCB (Metal Core Printed Circuit Board) 1009. As is known an MCPCB comprises a layered structure composed of a metal core base, typically aluminum, a thermally conducting/electrically insulating dielectric layer and a copper circuit layer for electrically connecting electrical components in a desired circuit configuration. With the aid of a thermally conducting compound such as for example a standard heat sink compound containing beryllium oxide or aluminum nitride the metal core base of the MCPCB 1009 is mounted in thermal communication with the body via the floor of the chamber 1005. As shown in FIG. 7A the MCPCB 1009 can be mechanically fixed to the body floor by one or more screws, bolts or other mechanical fasteners.

The downlight 1000 further comprises a hollow generally cylindrical light reflective chamber wall mask 1015 that surrounds the array of light emitters 1007. The chamber wall mask 1015 can be made of a plastics material and preferably has a white or other light reflective finish. A wavelength conversion component 101, such as the one described above in FIG. 1, may be mounted overlying the front of the chamber wall mask 1015 using, for example, an annular steel clip that has resiliently deformable barbs that engage in corresponding apertures in the body. The wavelength conversion component 101 is remote to the light emitters 1007.

The wavelength conversion component 101 comprises a layer of photo-luminescent material 107, a light transmissive substrate 109, and a color enhancement filter layer 111. The color enhancement filter layer 111 is configured to filter the undesirable wavelengths of the emission product of the layer of photo-luminescent material 107 such that a final emission product established by the wavelength conversion component 101 is highly saturated, as described above.

The downlight 1000 further comprises a light reflective hood 1025 which is configured to define the selected emission angle (beam spread) of the downlight (i.e. 60° in this example). The hood 1025 comprises a generally cylindrical shell with three contiguous (conjoint) inner light reflective frustoconical surfaces. The hood 1025 is preferably made of Acrylonitrile butadiene styrene (ABS) with a metallization layer. Finally the downlight 1000 can comprise an annular trim (bezel) 1027 that can also be fabricated from ABS.

Figure 8A:
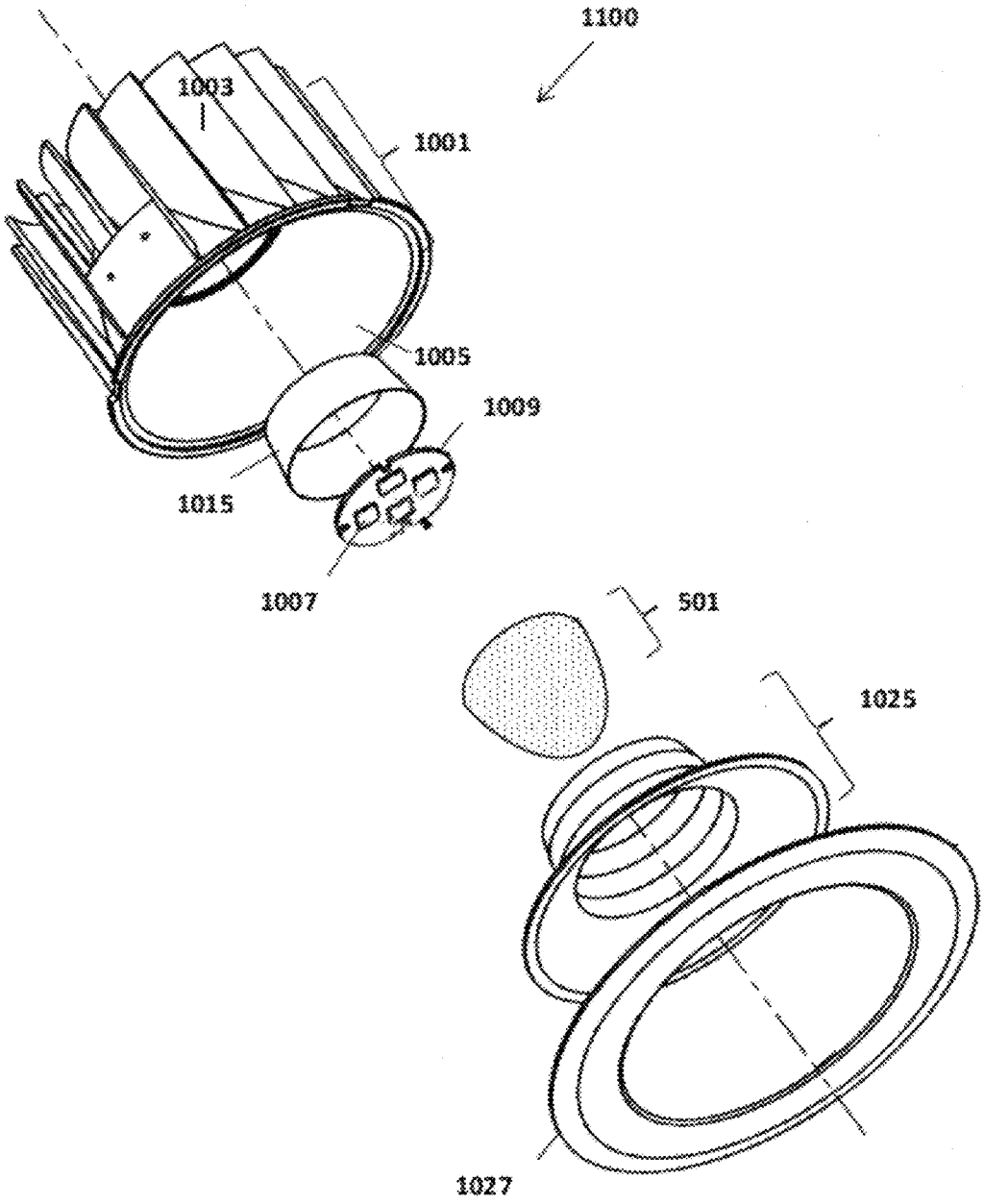
FIGS. 8A, 8B, and 8C illustrate another example of an application of a wavelength conversion component in accordance with some embodiments.
Figure 8B:
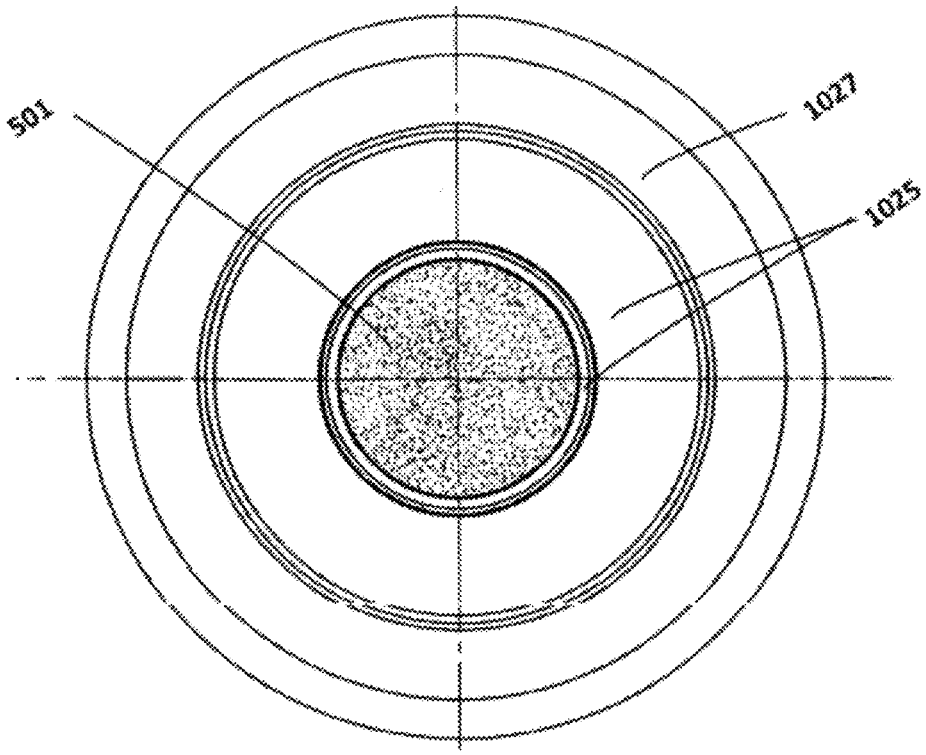
Figure 8C:
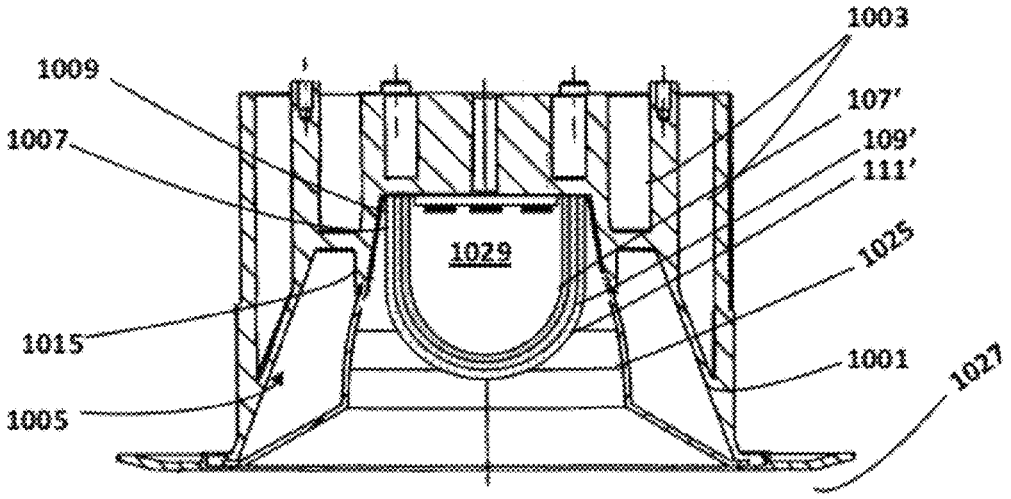

FIGS. 8A, 8B, and 8C illustrate another example of an application of a wavelength conversion component in accordance with some embodiments. FIGS. 8A, 8B, and 8C illustrate an LED downlight 1100 that utilizes remote wavelength conversion in accordance with some embodiments. FIG. 8A is an exploded perspective view of the LED downlight 1100, FIG. 8B is an end view of the downlight 1100, and FIG. 8C is a sectional view of the downlight 1100. The downlight 1100 is configured to generate light with an emission intensity of 650-700 lumens and a nominal beam spread of 60° (wide flood). It is intended to be used as an energy efficient replacement for a conventional incandescent six inch downlight.

The downlight 1100 of FIGS. 8A, 8B, and 8C is substantially the same as the downlight 1000 of FIGS. 7A, 7B, and 7C. For purposes of discussion, only features of the downlight 1100 that are new relative to the embodiments of FIGS. 7A, 7B, and 7C will be described.

Whereas the wavelength conversion component 101 of FIGS. 7A, 7B, and 7C has a two-dimensional shape (e.g., is substantially planar), the wavelength conversion component 501 of FIGS. 8A, 8B, and 8C has a three-dimensional shape (e.g., elongated dome shaped and/or ellipsoidal shell). The three dimensional wavelength conversion component 501 includes a three-dimensional layer of photo-luminescent material 107', a three-dimensional light transmissive substrate 109', and three-dimensional color enhancement filter layer 111', such as the wavelength conversion component 501 described above in FIG. 6. The wavelength conversion component 501 may also be mounted enclosing the front of the chamber wall mask 1015.

As discussed above, the color enhancement filter layer 111' is configured to filter the undesirable wavelengths of the emission product of the layer of photo-luminescent material 107' such that a final emission product established by the wavelength conversion component is highly saturated.

Figure 9:
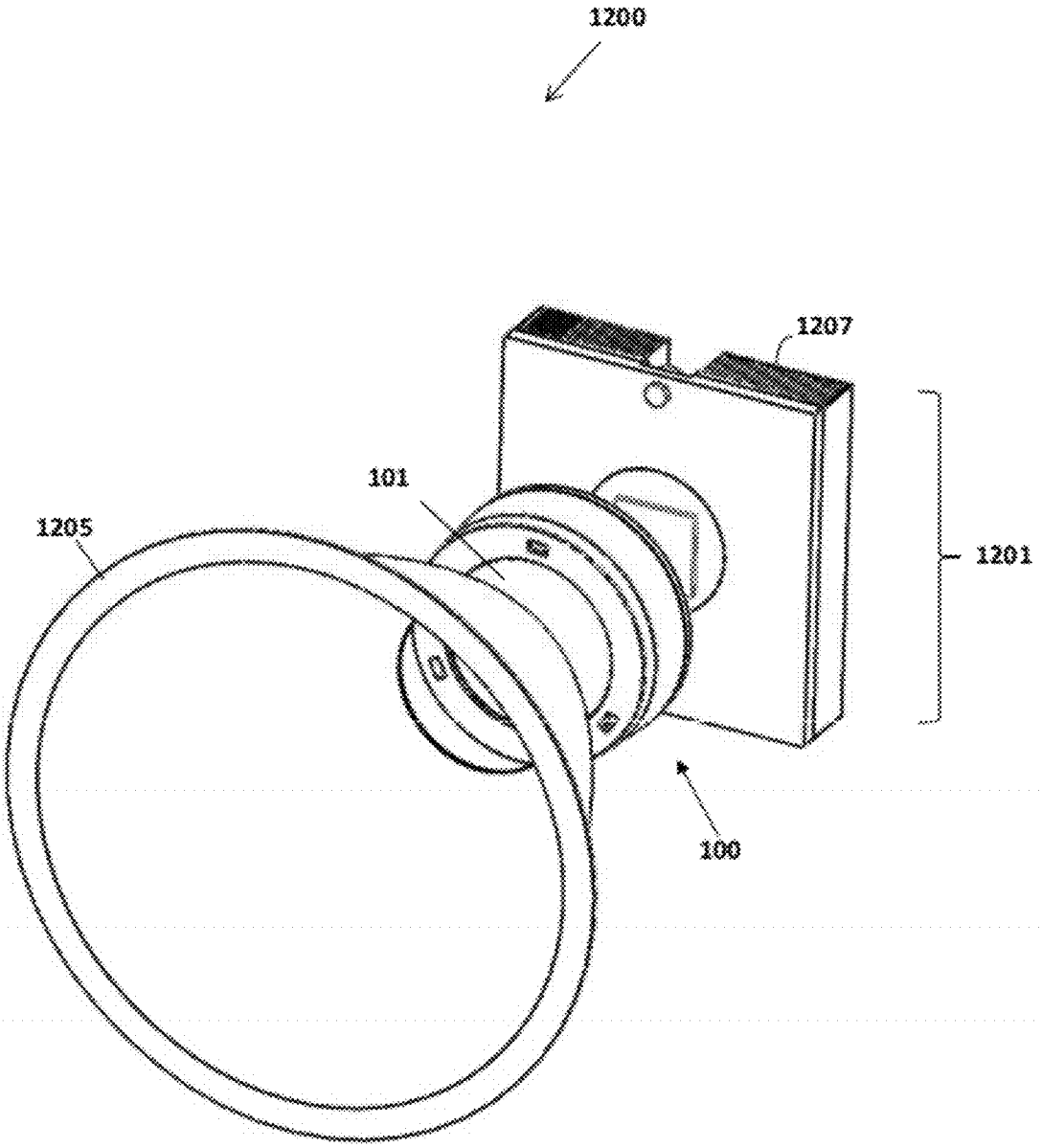
FIG. 9 illustrates another example of an application of a wavelength conversion component in accordance with some embodiments.

FIG. 9 illustrates another example of an application of a wavelength conversion component in accordance with some embodiments. FIG. 9 illustrates an exploded perspective view of a reflector lamp 1200 that utilizes remote wavelength conversion in accordance with some embodiments. The reflector lamp 1200 is configured to generate light with an emission intensity of 650-700 lumens and a nominal beam spread of 60° (wide flood). It is intended to be used as an energy efficient replacement for a conventional incandescent six inch downlight.

The reflector lamp 1200 comprises a generally rectangular thermally conductive body 1201 fabricated from, for example, die cast aluminum. The body 1201 functions as a heat sink and dissipates heat generated by a light emitting device 100, such as the one described above in FIG. 1. To increase heat radiation from the reflector lamp 1200 and thereby increase cooling of the light emitting device 100, the body 1201 can include a series of heat radiating fins 1207 located on the sides of the body 1201. To further increase the radiation of heat, the outer surface of the body 1201 can be treated to increase its emissivity such as for example painted black or anodized. The body 1201 further comprises a thermally conductive pad that may be placed in contact with a thermally conductive base of the light emitting device 100. The form factor of the body 1201 is configured to enable the reflector lamp 1200 to be retrofitted directly in a standard six inch downlighting fixture (a "can") as are commonly used in the United States.

A light emitting device 100 that includes a wavelength conversion component 101 such as the one described above with respect to FIG. 1 may be attached to the body 1201 such that the thermally conductive base of the light emitting device 100 may be in thermal contact with the thermally conductive pad of the body 1201. The light emitting device 100 may include a hollow cylindrical body with a base and sidewalls that is substantially the same as the cylindrical body described in FIG. 1 that is configured to house the wavelength conversion component 101.

While not illustrated, the wavelength conversion component 101 may include a layer of photo-luminescent material, a light transmissive substrate, and a color enhancement filter layer. The wavelength conversion component 101 may be configured to establish a highly saturated final emission product established by using the color enhancement filter layer to filter the undesirable wavelengths of the emission product of the layer of photo-luminescent material, as discussed above.

The reflector lamp 1200 further comprises a generally frustroconical light reflective light reflector 1205 having a paraboloidal light reflective inner surface which is configured to define the selected emission angle (beam spread) of the downlight (i.e. 60° in this example). The reflector 1205 is preferably made of Acrylonitrile butadiene styrene (ABS) with a metallization layer.

Figure 10A:
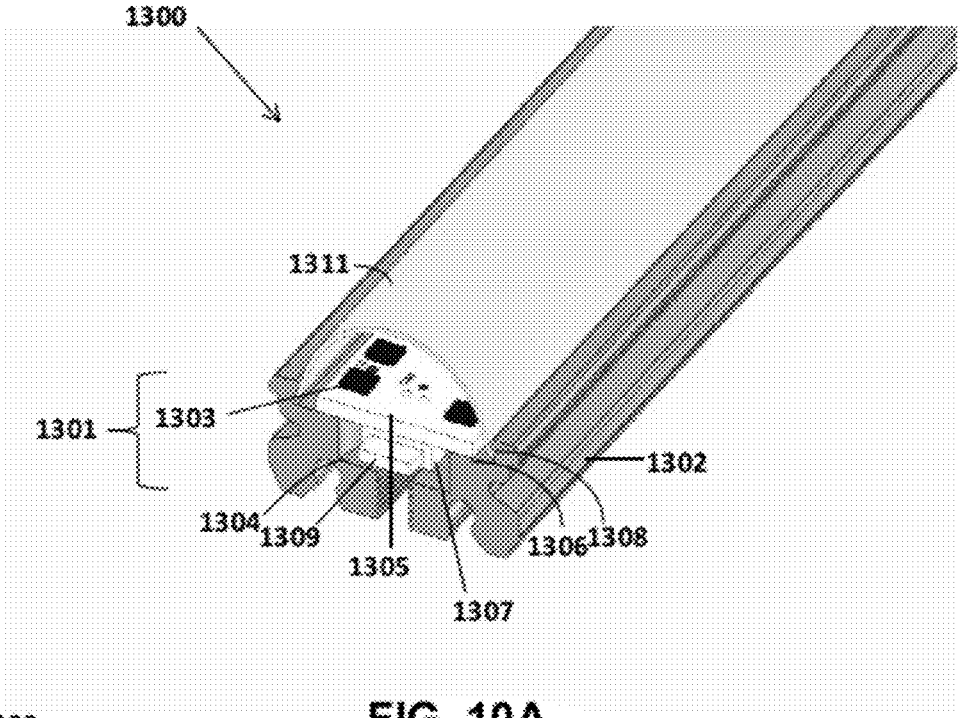
FIGS. 10A and 10B illustrate another example of an application of a wavelength conversion component in accordance with some embodiments.
Figure 10B:
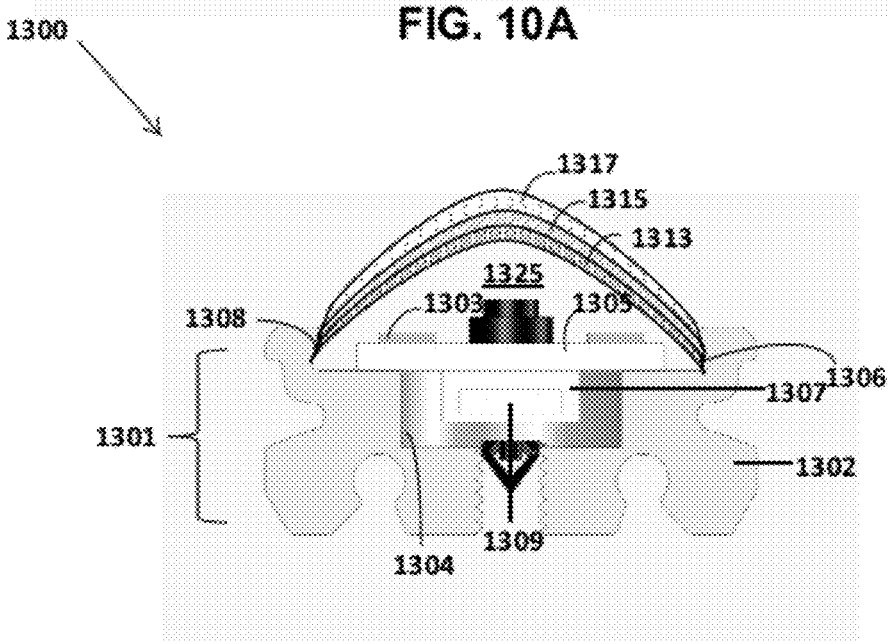

FIGS. 10A and 10B illustrate another example of an application of a wavelength conversion component in accordance with some embodiments. FIGS. 10A and 10B illustrate an LED linear lamp 1300 that utilizes remote wavelength conversion in accordance with some embodiments. FIG. 10A is a three-dimensional perspective view of the linear lamp 1300 and FIG. 10B is a cross-sectional view of the linear lamp 1300. The LED linear lamp 1300 is intended to be used as an energy efficient replacement for a conventional incandescent or fluourescent tube lamp.

The linear lamp 1300 comprises an elongated thermally conductive body 1301 fabricated from, for example, extruded aluminum. The form factor of the body 1301 is configured to be mounted with a standard linear lamp housing. The body 1301 further comprises a first recessed channel 1304, wherein a rectangular tube-like case 1307 containing some electrical components (e.g., electrical wires) of the linear lamp 1300 may be situated. The case 1307 may further comprise an electrical connector (e.g., plug) 1309 extending past the length of the body 1301 on one end, and a recessed complimentary socket (not shown) configured to receive a connector on another end. This allows several linear lamps 1300 to be connected in series to cover a desired area. Individual linear lamps 1300 may range from 1 foot to 6 feet in length.

The body 1301 functions as a heat sink and dissipates heat generated by the light emitters 1303. To increase heat radiation from the linear lamp 1300 and thereby increase cooling of the light emitters 1303, the body 1301 can include a series of heat radiating fins 1302 located on the sides of the body 1301. To further increase heat radiation from the linear lamp 1300, the outer surface of the body 1301 can be treated to increase its emissivity such as for example painted black or anodized.

Light emitters 1303 are mounted on a rectangular shaped MCPCB 1305 configured to sit above the first recessed channel 1304. The under surface of the MCPCB 1305 sits in thermal contact with a second recessed channel 1306 that includes inclined walls 1308.

A generally hemi-spherical elongated wavelength conversion component 1311 may be positioned remote to the light emitters 1303. The wavelength conversion component 1311 may be secured within the second recessed channel 1306 by sliding the wavelength conversion component 1311 under the inclined walls 1308 such that the wavelength conversion component 1311 engages with the inclined walls 1308. The wavelength conversion component 1311 may also be flexibly positioned under the inclined walls 1308 such that the wavelength conversion component 1311 engages with the inclined walls 1308.

The wavelength conversion component 1311 may include a hemi-spherical elongated layer of photo-luminescent material 1313, a hemi-spherical elongated light transmissive substrate 1315, and a hemi-spherical elongated color enhancement filter layer 1317. As discussed above, the color enhancement filter layer 1317 is configured to filter the undesirable wavelengths of the emission product of the layer of photo-luminescent material 1313 such that a final emission product established by the wavelength conversion component 1311 is highly saturated.

In alternative embodiments, the wavelength conversion component of the linear lamp may be configured in the shape of a generally planar strip. In such embodiments, it will be appreciated that the second recessed channel may instead have vertical walls that extend to allow the wavelength conversion component to be received by the second recessed channel.

Figure 11A:
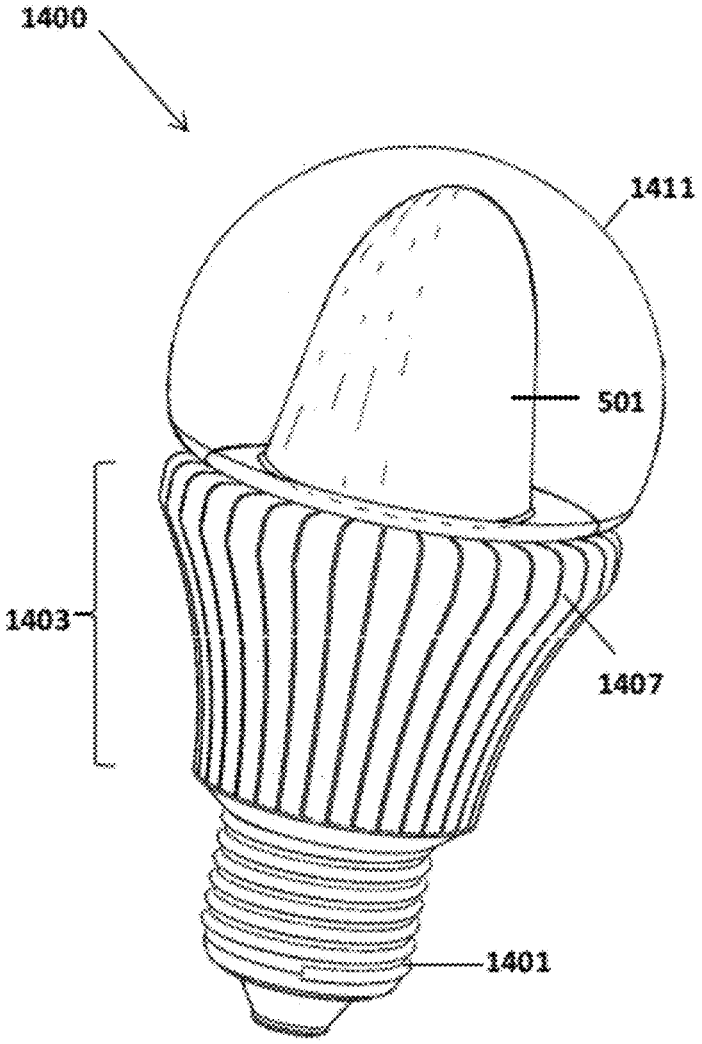
FIGS. 11A and 11B illustrate a perspective view and a cross-sectional view of an application of a wavelength conversion component in accordance with some embodiments.
Figure 11B:
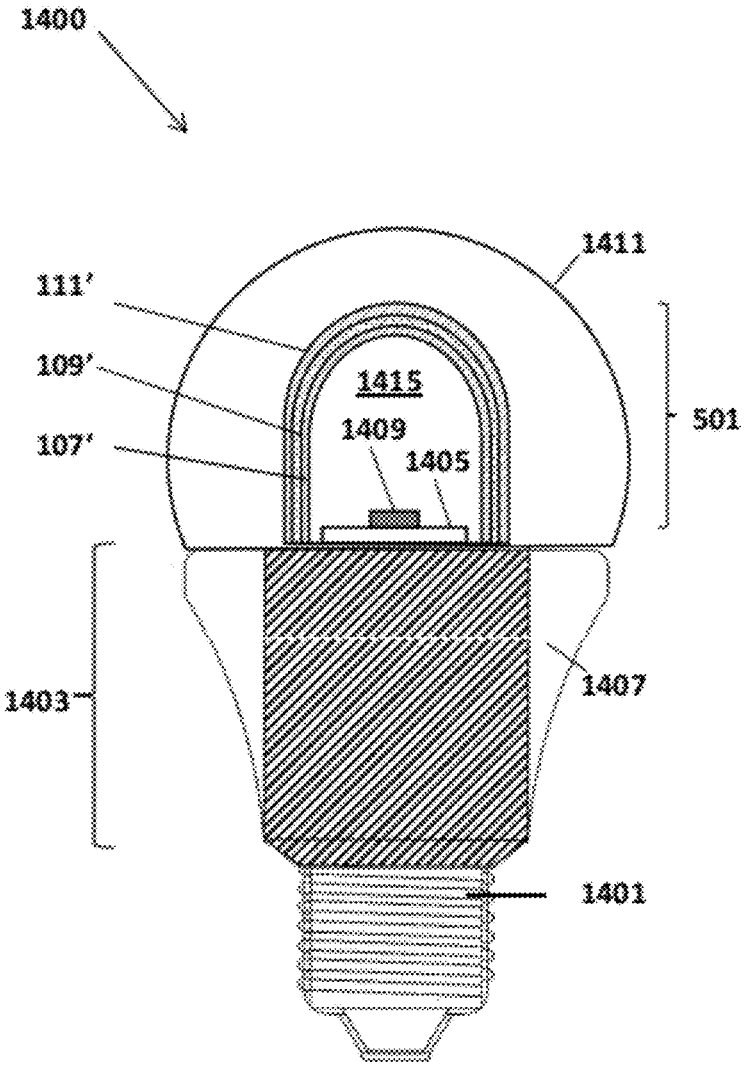

FIGS. 11A and 11B illustrate a perspective view and a cross-sectional view of an application of a wavelength conversion component in accordance with some embodiments. FIGS. 11A and 11B illustrate an LED light bulb that utilizes remote wavelength conversion. The LED light bulb 1400 is intended to be used as an energy efficient replacement for a conventional incandescent or fluourescent light bulb.

The light bulb 1400 comprises a screw base 1401 that is configured to fit within standard light bulb sockets, e.g. implemented as a standard Edison screw base. The light bulb 1400 may further comprise a thermally conductive body 1403 fabricated from, for example, die cast aluminum. The body functions as a heat sink and dissipates heat generated by the light emitters 1409, which are mounted on a MCPCB 1405. The MCPCB 1405 may be in thermal contact with the body 1403. To increase heat radiation from the light bulb 1400 and thereby increase cooling of the light bulb 1400, the body 1403 can include a series of latitudinal radially extending heat radiating fins 1407. To further increase the radiation of heat, the outer surface of the body 1403 can be treated to increase its emissivity such as for example painted black or anodized.

The light bulb 1400 further comprises a wavelength conversion component 501, such as the one described above in FIG. 6, having a three-dimensional shape (e.g., elongated dome shaped and/or ellipsoidal shell) that encloses the light emitters 1409. The three dimensional wavelength conversion component 501 includes a three-dimensional layer of photo-luminescent material 107', a three-dimensional light transmissive substrate 109', and a three-dimensional color enhancement filter layer 111'.

As discussed above, the color enhancement filter layer 111' is configured to filter the undesirable wavelengths of the emission product of the layer of photo-luminescent material 107' such that a final emission product established by the wavelength conversion component 501 is highly saturated.

An envelope 1411 may extend around the upper portion of the LED light bulb 1400, enclosing the light emitters 1409 and the wavelength conversion component 501. The envelope 1411 is a light-transmissive material (e.g. glass or plastic) that provides protective and/or diffusive properties for the LED light bulb 1400.

The above applications of light emitting devices describe a remote wavelength conversion configuration, wherein a wavelength conversion component is remote to one or more light emitters. The wavelength conversion component and body of those light emitting devices define an interior volume wherein the light emitters are located. The interior volume may also be referred to as a light mixing chamber. For example, in the downlight 1000, 1100 of FIG. 7A, 7B, 7C, 8A, 8B, and 8C, an interior volume 1029 is defined by the wavelength conversion component 101, 501, the light reflective chamber mask 1015, and the body of the downlight 1001. In the linear lamp 1300 of FIG. 10A and 10B, an interior volume 1325 is defined by the wavelength conversion component 1311 and the body of the linear lamp 1301. In the light bulb 1400 of FIG. 11A and 11B, an interior volume 1415 is defined by the wavelength conversion component 501 and the body of the light bulb 1407. Such an interior volume provides a physical separation (air gap) of the wavelength conversion component from the light emitters that improves the thermal characteristics of the light emitting device. Due to the isotropic nature of photoluminescence light generation, approximately half of the light generated by the phosphor material can be emitted in a direction towards the light emitters and can end up in the light mixing chamber. It is believed that on average as little as 1 in a 10,000 interactions of a photon with a phosphor material particle results in absorption and generation of photoluminescence light. The majority, about 99.99%, of interactions of photons with a phosphor particle result in scattering of the photon. Due to the isotropic nature of the scattering process on average half the scattered photons will be in a direction back towards the light emitters. As a result up to half of the light generated by the light emitters that is not absorbed by the phosphor material can also end up back in the light mixing chamber. To maximize light emission from the device and to improve the overall efficiency of the light emitting device the interior volume of the mixing chamber includes light reflective surfaces to redirect—light in—the interior volume towards the wavelength conversion component and out of the device. The light mixing chamber can be defined by the wavelength conversion component in conjunction with another component of the device such a device body or housing (e.g., dome-shaped wavelength conversion component encloses light emitters located on a base of device body to define light mixing chamber, or planar wavelength conversion component placed on a chamber shaped component to enclose light emitters located on a base of device body and surrounded by the chamber shaped component to define light mixing chamber). For example, the downlight 1000, 1100 of FIGS. 7A, 7B, 7C, 8A, 8B, and 8C, includes an MCPCB 1009, on which the light emitters 1007 are mounted, comprising light reflective material and a light reflective chamber wall mask 1015 to facilitate the redirection of light reflected back into the interior volume towards the wavelength conversion component 101, 501. The linear lamp 1300 of FIGS. 10A and 10B includes an MCPCB 1305, on which the light emitters 1303 are mounted, comprising light reflective material to facilitate the redirection of light reflected back into the interior volume towards the wavelength conversion component 1311. The light bulb 1400 of FIGS. 11A and 11B also includes an MCPCB 1405, on which the light emitters 1409 are mounted, to facilitate the redirection of light reflected back into the interior volume towards the wavelength conversion component 501.

The above applications of light emitting devices describe only a few embodiments with which the claimed invention may be applied. It is important to note that the claimed invention may be applied to several other light emitting device applications, including but not limited to, wall lamps, pendant lamps, chandeliers, recessed lights, track lights, accent lights, stage lighting, movie lighting, street lights, flood lights, beacon lights, security lights, traffic lights, headlamps, taillights, signs, etc.

Therefore, what has been described is a wavelength conversion component with improved color characteristics for remote wavelength conversion. The improved wavelength conversion component comprises a wavelength conversion layer, a light transmissive substrate, and a color enhancement filter layer. By providing the color enhancement filter layer, undesirable wavelengths of the emission product of the layer of photo-luminescent material may be filtered such that a final emission product established by the wavelength conversion component is highly saturated.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than restrictive sense.

What is claimed is:

1. A light emitting device configured to emit light of a selected color having a selected peak wavelength, comprising:

a radiation source operable to generate and radiate excitation energy, the source being configured to irradiate a wavelength conversion component with excitation energy;

the wavelength conversion component comprising:

a layer comprising a photo-luminescent material which, when irradiated by the radiation source, emits light of a first wavelength range having a single peak wavelength corresponding to the selected peak wavelength; and a color enhancement filter layer to filter wavelengths of light outside of a second wavelength range, wherein the second wavelength range is narrower than the first wavelength range and centered on the selected peak wavelength.

2. The light emitting device of claim 1, wherein the radiation source is a blue LED.

3. The light emitting device of claim 1, wherein the radiation source is a U.V. emitting LED.

4. The light emitting device of claim 1, wherein the wavelength conversion component further comprises a light transmissive substrate, the layer of photo-luminescent material being provided on first surface of the light transmissive substrate and the color enhancement filter layer being provided on a second surface of the light transmissive substrate.

5. The light emitting device of claim 1, wherein the wavelength conversion component further comprises a first light transmissive substrate and a second light transmissive substrate, wherein the layer of photo-luminescent material and the color enhancement filter layer are disposed between the first and second light transmissive substrates.

6. The light emitting device of claim 4, wherein the light transmissive substrate is selected from a group consisting of: a plastics material, polycarbonate, a thermoplastics material, a glass, acrylic, polythene, and a silicone material.

7. The light emitting device of claim 1, wherein the wavelength conversion component further comprises a light transmissive substrate, the layer of photo-luminescent material being provided on a surface of the light transmissive substrate and the color enhancement filter layer being provided on a surface of the photo-luminescent material.

8. The light emitting device of claim 7, further comprising an additional light transmissive substrate on a surface of the color enhancement filter layer.

9. The light emitting device of claim 8, wherein the light transmissive substrate and additional light transmissive substrate are selected from a group consisting: a plastics material, polycarbonate, a thermoplastics material, a glass, acrylic, polythene, and a silicone material.

10. The light emitting device of claim 1, wherein the wavelength conversion component takes on a three-dimensional shape.

11. The light emitting device of claim 1, wherein the layer of photo-luminescent material is composed of a material selected from a group consisting: ortho silicate, silicate and aluminate materials.

12. The light emitting device of claim 1, wherein the color enhancement filter layer comprises a color pigment or colored dye.

13. The light emitting device of claim 1, wherein the color enhancement filter layer filters out a portion of a range of wavelengths corresponding to the emission product of the layer of photo-luminescent material such that the final emission product for the light emitting device comprises a full width half maximum (FWHM) of the range of wavelengths corresponding to the emission product of the layer of photo-luminescent material.

14. The light emitting device of claim 1, wherein the light emitting device is selected from the group consisting of: downlights, light bulbs, linear lamps, lanterns, wall lamps, pendant lamps, chandeliers, recessed lights, track lights, accent lights, stage lighting, movie lighting, street lights, flood lights, beacon lights, security lights, traffic lights, headlamps, taillights, and signs.

15. A linear lamp configured to emit light of a selected color having a selected peak wavelength, comprising:

an elongate housing;

a plurality of solid-state light emitters housed within the housing and configured along the length of the housing; and an elongate wavelength conversion component remote to the plurality of solid-state light emitters and configured to in part at least define a light mixing chamber, wherein the elongate wavelength conversion component comprises an elongate layer of photo-luminescent material to emit light of a first wavelength range having a single peak wavelength corresponding the selected peak wavelength when irradiated by light from the plurality of solid-state light emitters; and an elongate color enhancement filter layer to filter wavelengths of light outside of a second wavelength range, wherein the second wavelength range is narrower than the first wavelength range and centered on the selected peak wavelength.

16. A downlight configured to emit light of a selected color having a selected peak wavelength, comprising:

a body comprising one or more solid-state light emitters, wherein the body is configured to be positioned within a downlighting fixture such that the downlight emits light in a downward direction; and a wavelength conversion component remote to the one or more solid-state light emitters and configured to in part at least define a light mixing chamber, wherein the wavelength conversion component comprises:

a layer comprising a photo-luminescent material which, when irradiated by the radiation source, emits light of a first wavelength range having a single peak wavelength corresponding to the selected peak wavelength; and a color enhancement filter layer to filter wavelengths of light outside of a second wavelength range, wherein the second wavelength range is narrower than the first wavelength range and centered on the selected peak wavelength.

17. A light bulb configured to emit light of a selected color having a selected peak wavelength, comprising:

a connector base configured to be inserted in a socket to form an electrical connection for the light bulb;

a body comprising one or more solid-state light emitters;

a wavelength conversion component having a three dimensional shape that is configured to enclose the one or more solid-state light emitters and to in part at least define a light mixing chamber, wherein the wavelength conversion component comprises:

a layer of photo-luminescent material to emit light of a first wavelength range having a single peak wavelength corresponding to the selected peak wavelength when irradiated by light from the one or more of solid-state light emitters; and a color enhancement filter layer to filter wavelengths of light outside of a second wavelength range, wherein the second wavelength range is narrower than the first wavelength range and centered on the selected peak wavelength.

* * * * *